US005308513A

United States Patent [19]

Harmalker et al.

[11] Patent Number: 5,308,513

[45] Date of Patent: May 3, 1994

[54] WASH CYCLE OR RINSE CYCLE FABRIC CONDITIONING COMPOSITIONS

[75] Inventors: Subhash Harmalker, Somerset; Nagaraj S. Dixit, Plainsboro; Kevin M. Kinscherf, Freehold, all of N.J.

[73] Assignee: Colgate-Palmolive Company, New York, N.Y.

[21] Appl. No.: 21,392

[22] Filed: Feb. 23, 1993

Related U.S. Application Data

[63] Continuation-in-part of Ser. No. 704,833, May 20, 1991, abandoned, which is a continuation-in-part of Ser. No. 555,683, Jul. 20, 1990, abandoned.

[51] Int. Cl.[5] ..... C11D 3/22; C11D 1/40; C11D 1/65; D06M 13/342

[52] U.S. Cl. ..... 252/8.8; 252/174.17; 252/174.19; 252/544; 252/546; 252/DIG. 14

[58] Field of Search ..... 252/174.17, 8.8, 544, 252/525, 8.6, 174.19, DIG. 14, 527, 546

[56] References Cited

U.S. PATENT DOCUMENTS

| | | | |
|---|---|---|---|
| 4,136,038 | 1/1979 | Pracht et al. | 252/8.8 |
| 4,808,086 | 2/1989 | Evans et al. | 427/242 |
| 4,828,722 | 5/1989 | Steltenkamp | 252/8.8 |
| 4,869,836 | 9/1989 | Harmalker | 252/8.8 |
| 4,954,270 | 9/1990 | Butterworth et al. | 252/8.8 |
| 5,009,800 | 4/1991 | Foster | 252/8.9 |
| 5,160,641 | 11/1992 | Foster | 252/8.6 |

FOREIGN PATENT DOCUMENTS

| | | |
|---|---|---|
| 0267657 | 5/1988 | European Pat. Off. . |
| 0331237 | 9/1989 | European Pat. Off. . |
| 0340872 | 11/1989 | European Pat. Off. . |
| 2601390 | 1/1988 | France . |

OTHER PUBLICATIONS

EP Search Report for EP 91 20 1908, Oct. 28, 1991.

*Hackh's Chemical Dictionary*, 4th ed. (1972), ed. Julius Grant, p. 240.

*Primary Examiner*—Paul Lieberman

*Assistant Examiner*—Ardith Hertzog

*Attorney, Agent, or Firm*—Barnard Lieberman; Robert C. Sullivan

[57] ABSTRACT

Fabric conditioning aqueous liquid emulsions are provided which impart softness and antistatic properties to laundered fabrics as a wash-cycle additive for through-the-wash use or alternatively as a rinse cycle additive. The dispersed phase of the liquid emulsions comprise complexes of specified tertiary amines and multi-functional carboxylic acids in combination with unreacted amine and a minor amount of one or more specified alkyl cellulose ethers to enhance high temperature emulsion stability.

22 Claims, No Drawings

WASH CYCLE OR RINSE CYCLE FABRIC CONDITIONING COMPOSITIONS

BACKGROUND OF THE INVENTION

This application is a continuation-in-part of U.S. Ser. No. 07/704,833 filed May 20, 1991 (now abandoned) which is a continuation-in-part of 07/555,683 filed Jun. 20, 1990, (now abandoned) the disclosures of which are incorporated herein by reference.

This invention relates to novel aqueous liquid emulsions useful as through-the-wash or rinse cycle-additive fabric conditioning compositions and their method of manufacture, such fabric conditioning compositions providing softening and antistatic benefits to laundered fabrics without adversely affecting cleaning.

A large number of compositions have been disclosed 7hich impart softening and antistatic properties to laundered fabrics. Generally, these contain cationic compounds, especially quaternary ammonium salts. Such compositions are widely marketed for home use in the form of emulsions which must be added to the washing machine during the rinse cycle. If the emulsions are added during the wash cycle, the cationic fabric conditioners may interact with anionic surfactants present in the washing composition so as to render a portion of each of such cationic compound and anionic surfactant unavailable for either cleaning or fabric conditioning.

Another means of providing fabric conditioning 7hich has attained some commercial success is to add the conditioning agent while the clothes are being machine dried.

While fabric conditioning during either the rinse and/or drying cycles can be effective, both methods of conditioning are more inconvenient than a through-the-wash method where the conditioning agent is added with the detergent composition at the initiation of the wash cycle.

C/mpositions are known which can be added to a washing machine at the start of the wash cycle and effectively provide fabrics with a detergency treatment during the wash cycle and a fabric conditioning treatment during either the rinsing operation or subsequently when the fabrics are heated in a machine dryer. Compositions of this type are known in the art as through-the-wash fabric conditioners. An important advantage of such compositions is that they obviate the need for adding a separate fabric conditioning product in the rinse cycle or in a machine dryer.

Through-the-wash type conditioning agents are well known in the art. European Patent Application No. 0,123,400, published Oct. 31, 1984 discloses fabric conditioning agents comprising salts of specified tertiary amines and carboxylic acids 7hich are utilized in the form of nodules which pass virtually unchanged through the wash and rinse and condition the fabric when heated in a dryer. The nodules are meant to be added to the laundry wash liquor at the beginning of the wash cycle along with a conventional detergent. European Patent Publication No. 0,133,804 published Mar. 6, 1985 discloses detergent compositions containing clay fabric softeners and particles of a complex of a long chain amine and a fatty acid. U.S. Pat. No. 4,514,444 to Ives discloses a fabric cleaning/conditioning composition comprising carboxylic acid salts of a tertiary amine in combination with polyethylene glycol. U.S. Pat. No. 4,375,416 to Crisp et al. discloses a textile softening detergent composition comprising a specified class of tertiary amines with a smectite-type clay in a detergent composition such that softening benefits are provided without impairing cleaning performance.

Other recent prior art relating to the field of the invention includes U.S. Pat. No. 4,237,155 to Kardouche which discloses a dryer-added fabric conditioning agent comprised of a carboxylic acid salt of a tertiary amine. British Patent 1,514,276 discloses the use of tertiary amine compositions as wash-cycle fabric softeners.

U.S. Pat. No. 4,808,086 to Evans et al discloses dryer-added fabric conditioning articles comprised of a fabric softening agent and a soil release agent which may be certain defined hydroxyethers of cellulose. The soil release agent may be present in amounts up to 70%, by weight, of 4he composition and preferably from about 25 to 50%.

European Patent Application 331,237 naming Butterworth et al as inventors discloses fabric conditioning compositions containing a polymeric thickener for fabric softening compositions. The polymeric thickeners are hydrophobically modified cellulose ethers, and the preferred softening materials are quaternary ammonium compounds. Insofar as conventional quat rinse-cycle softening compositions have very low viscosities in the absence of thickeners (i.e. generally about 30–40 cps.), the Butterworth et al European patent seeks to provide a thickened quat softening composition. Referring to Table 4 of the Butterworth et al European Patent, for example, the unthickened control is shown to have a viscosity of 5 which upon addition of a designated hydroxyethyl cellulose at weight percents of 0.13 and 0.15%, respectively, is shown to be raised to 78 and 101, a viscosity increase of one order of magnitude. The carboxylic acid-amine complexes of the present invention, on the other hand, are relatively thick compositions at useful concentration of 5 to 10%, by weight, having viscosities of about 500 cps. at room temperature. Hence, the combination of carboxylic acid-amine complexes as herein described with a thickener of any type is unnecessary and undesirable. By way of comparison, the addition of an alkyl cellulose either to a fabric conditioning composition in accordance with the invention provides essentially no increase in viscosity to the resultant composition, and, in some instances, even causes the viscosity to be lowered.

C/mplexes of specified tertiary amines and carboxylic acids have been previously disclosed as through-the-wash fabric conditioners in U.S. Pat. No. 4,828,722 to Steltenkamp. In U.S. Pat. No. 4,869,836 to Harmalker there is described the combination of unreacted tertiary amine with a complex of reacted tertiary amine and multi-functional carboxylic acid. The resulting fabric conditioners are used advantageously in the form of aqueous liquid emulsions. While these emulsions are generally effective for fabric conditioning, they nevertheless are often destabilized or suffer poor performance when subjected to extreme conditions, such as elevated temperatures, i.e. above 110° F. C/nsequently, there remains a need for providing an effective fabric-conditioning liquid emulsion capable of being used as either a wash-cycle or rinse-cycle additive, and which is highly stable at elevated temperatures.

SUMMARY OF THE INVENTION

The present invention provides a wash cycle or rinse cycle-additive aqueous liquid emulsion for providing softness and anti-static properties to fabrics treated therewith in a laundry bath without adversely affecting fabric cleaning comprising (A) from about 1 to 30%, by weight of a particulate fabric conditioning composition having a median particle diameter greater than about 10 and up to about 50 microns comprising:

(a) a fabric conditioning amount of a multi-functional carboxylic acid complex of a tertiary amine formed from the reaction of (i) a tertiary amine having the general formula:

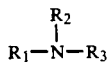

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tricarboxylic acids having from 21 to 54 carbon atoms;

(b) unreacted tertiary amine having the general formula defined above, said unreacted amine being present in an amount of at least 0.2 times the stoichiometric amount of tertiary amine required to form the multi-functional carboxylic acid complex of (a); and (c) an emulsion stabilizing amount of an alkyl cellulose ether selected from the group consisting of methylcellulose, hydroxypropylmethyl cellulose and derivatives of hydroxyethyl cellulose wherein the terminal hydrogen of the hydroxyether group is replaced by an alkyl chain having from 10 to 24 carbon atoms, and mixtures thereof, said alkyl cellulose ether having a molecular weight of at least 25,000, the emulsion stabilizing amount of alkyl cellulose ether relative to the fabric conditioning amount of carboxylic acid complex of a tertirary amine defined in (a) being less than about 1:20, by weight, and which emulsion stabilizing amount of cellulose ether provides no improved fabric softening performance for said fabric conditioning composition, the dispersed phase of the liquid emulsion being essentially comprised of said particles of fabric conditioning composition.

(B) from about 0.1 to 10%, by weight of one or more emulsifying agents; and (C) the balance 7ater.

The most effective fabric conditioning compositions of the invention contain an amount of unreacted tertiary amine varying from about 0.3 to 6 times the stoichiometric amount of reacted amine in the complex, preferably from about 0.6 to 6 times the said stoichiometric amount. Where, for example, the multi-functional carboxylic acid selected to form the complex is citric acid, the stoichiometric amount of reacted amine in the complex is 3 moles of amine per mole of citric acid.

The term "complex" as used throughout the specification and claims refers to the reaction product of the above described tertiary amine and carboxylic acid, and characterizes such reaction product in terms of the primary constituent thereof which is a complex rather than a salt of the acid and amine. The basis of such characterization is explained hereinafter in the specification. Although the applicant does not wish to be limited by any theory regarding the nature of such reaction product, it is believed to be an equilibrium mixture comprised of the acid-amine complex (about 80%, by weight) and the acid-amine salt (about 20%, by weight). Accordingly, as used herein, the term "complex" includes both the acid-amine complex formed by the reaction of the tertiary amine and carboxylic acid as well as the relatively minor amount of salt in equilibrium therewith.

In accordance with a preferred embodiment of the invention, the aqueous liquid emulsion contains adjuvants such as perfumes, colorants, brighteners, foam stabilizers and the like and, optionally further includes an antistatic composition distinct from the defined fabric conditioning composition to enhance the anti-static properties of the liquid emulsion. A preferred additional anti-static composition for this purpose is tallow neodecanamide.

In accordance with the process aspect of the invention, softness and anti-static properties are imparted to fabrics by contacting such fabrics in a laundry bath or rinse liquor with an aqueous liquid emulsion containing an effective amount of a particulate fabric conditioning composition having a median particle diameter greater than about 10 and up to about 50 microns, which fabric conditioning composition comprises:

(a) a fabric conditioning amount of a multi-functional carboxylic acid complex of a tertiary amine formed from the reaction of (i) a tertiary amine having the general formula:

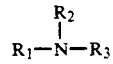

7herein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tricarboxylic acids having from 21 to 54 carbon atoms;

(b) unreacted tertiary amine having the general formula defined above, said unreacted amine being present in an amount of at least 0.2 times the stoichiometric amount of tertiary amine required to form the multi-functional carboxylic acid complex of (a); and (c) an emulsion stabilizing amount of an alkyl cellulose ether selected from the group consisting of methylcellulose, hydroxypropylmethyl cellulose and derivatives of hydroxyethyl cellulose wherein the terminal hydrogen of the hydroxyether group is replaced by an alkyl chain having from 10 to 24 carbon atoms, and mixtures thereof, said alkyl cellulose ether having a molecular weight of at least 25,000, the emulsion stabilizing amount of alkyl cellulose ether relative to the fabric conditioning amount of carboxylic acid complex of a tertiary amine defined in (a) being less than about 1:20, by 7eight, and which emulsion stabilizing amount of cellulose ether provides no improved fabric softening performance for said fabric conditioning composition.

Although the applicants do not wish to be bound by any theory of operation, it is believed that the alkyl cellulose ether incorporated into the liquid emulsion of the invention forms at least a partial coating upon the particles of fabric conditioning composition which are formed upon emulsification. This coating appears to substantially prevent particle break-down over a wide range of temperatures as well as the undesired subsequent coalescence of smaller particles of acid-amine complex into larger aggregate particles, a problem characteristic of liquid emulsions known in the art containing particulate complexes of carboxylic acid and amine which are typically susceptible to high temperature breakdown and concomitant product separation. It has further been discovered that for particulate compositions having a median particle diameter above about 10 microns, and more preferably at median particle sizes from about 25 to 50 microns, the fabric conditioning, physical stability and flow characteristics of the resulting liquid emulsion are at an optimum. Accordingly, for the fabric conditioning compositions of the invention the desired range of particle size is able to be maintained over a broad range of temperature extending from ambient to above the melting point of the carboxylic acid-amine complex, typically about 110° F.

The alkyl cellulose ether as used herein provides no fabric softening benefit to the fabric conditioning composition.

DETAILED DESCRIPTION OF THE INVENTION

The fabric conditioning compositions of the invention are comprised of three essential components. The first and second components are, respectively, a complex of tertiary amine with a multi-functional carboxylic acid as herein defined and unreacted tertiary amine. The suitable tertiary amines are represented by the general formula

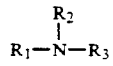

wherein $R_1$ is methyl or ethyl, and $R_2$ and $R_3$ are each independently an aliphatic group having from 12 to 22 carbon atoms. Examples of preferred amines include methyl distearyl amine, ethyl distearyl amine, methyl di(hydrogenated tallow) amine, ethyl di(hydrogenated tallow) amine, methyl diolelylamine, methyl dicoconut amine, methyl dilaurylamine, and methyl dipalm oil amine.

The multi-functional carboxylic acid utilized in the present invention is selected from among citric acid and di and tri carboxylic acids having 21 to 54 carbon atoms. Most preferred for use herein is citric acid. Among the other preferred acids are a dicarboxylic acid having 21 carbon atoms e.g. 5 (or 6)-carboxy-4 hexyl-2-cyclohexene-1-octanoic acid (sold commercially under the tradename Westvaco Diacid 1550 by Westvaco C/rporation): dimerized oleic acid (sold commercially under the tradename Dimer Acid by Emery Industries); and a $C_{54}$ trimer of oleic acid.

The amine-multifunctional carboxylic acid complexes of the invention are generally prepared by forming a mixture of amine and multicarboxylic acid, preferably in a molar ratio of amine to carboxylic acid above that required for the stoichiometric reaction so as to provide the desired amount of unreacted amine in the reaction product, and heating such mixture to a temperature sufficient to form a melt.

F/r the example of a tertiary amine having a melting point below 4hat of the carboxylic acid, preparation is conveniently effected by first heating the amine to its melting point (generally about 35° to 45° C.) and then adding thereto the multicarboxylic acid, such as for example citric acid, in the form of a solid. The resulting mixture is then heated to a temperature below the melting point of the carboxylic acid, but sufficient to form a molten mixture. In the case of citric acid, heating the reactant to a temperature of about 115° C. for about five to ten minutes will form a molten mixture having a melting point (about 50° C.) intermediate of the citric acid and the amine. The molten mixture comprises the reaction product of amine-multicarboxylic acid complex in equilibrium with a minor amount of amine-carboxylic acid salt.

In an alternate embodiment, the amine and carboxylic acid are reacted in a stoichiometric ratio to form the complex followed by the addition of unreacted tertiary amine to the resulting reaction product. This embodiment is particularly advantageous where it is desired to employ an unreacted amine in the fabric condition composition 7hich is different from the reacted amine. This may be desirable in some instances for purposes of economy.

The determination of the nature of the reaction product can be illustrated in terms of the reaction between methyl di(hydrogenated tallow) amine and dimerized oleic acid which 7ere mixed and heated following the general procedure described above except that in this instance the amine having a melting point above the carboxylic acid is added in solid form to dimerized oleic acid which is liquid at ambient temperature. The resulting reaction product was identified as a weak hydrogen bonded complex (80 wt. %) in equilibrium with the corresponding salt (20 wt. %). Identification was based on measurements involving melting points and spectroscopic techniques. The complex melted at 28° to 31° C. which is intermediate between the melting point of the amine (34° to 38° C.) and the carboxylic acid (4° to 5° C.). This indicates the formation of a complex rather than an amine salt, the latter being characterized by a sharp melting point higher than the corresponding amine.

The Infra red spectrum of the complex shows the presence of two moderate carbonyl bands at wavelengths of 1709 $cm^{-1}$ and 1550 $cm^{-1}$. The 935 $cm^{-1}$ wavelength indicative of H-bonding of the particular free carboxylic acid is absent, indicating the presence of a complex rather than salt formation. By means of ESCA (Election Spectroscopy for Chemical Analysis) measurements, it was determined that the reaction product was about 20% amine salt and 80% of the amine-carboxylic acid complex. The chemical shift of the ionic nitrogen of the salt was different than that of the neutral nitrogen of the complex. The relative amounts of these two nitrogen signals provide the basis for determining the relative amount of amine salt versus amine complex.

An alkyl cellulose ether is the third essential component of the particulate fabric conditioning composition. Suitable alkyl cellulose ethers are selected from among methylcellulose and hydroxypropylmethyl cellulose, sold under the trademark "Methocel" by D/w Chemical Company; hydroxypropylcellulose, sold under the trademark "Klucel" by Hercules Chemical Company; and derivatives of hydroxyethyl cellulose (HEC) wherein the terminal hydrogen of the hydroxyether group is replaced by an alkyl chain having from 10 to 24 carbon atoms, such HEC derivatives being sold under the trademark "Natrosol Plus" by Hercules Chemical C/mpany, and are extensively described in U.S. Pat. No. 4,228,277 issued Oct. 14, 1980. The amount of alkyl cellulose ether present in the particulate fabric conditioning composition is generally from about 0.1 to 5%, by weight, of the aqueous liquid emulsion, and preferably, from about 0.1 to 1%, by weight, and most preferably from about 0.1 to 0.5% in order to provide the requisite high temperature stability to the particles of fabric conditioning composition. It is believed that the alkyl cellulose ether must be of sufficient viscosity in the emulsion to deposit on the surface of the emulsion particles and form an elastic film or coating thereon. Hence, the molecular weight of the cellulose ether required for this stabilizing purpose is at least 25,000 and preferably at least 30,000.

The aqueous liquid emulsion of the invention may be advantageously added to the laundry bath or to the rinse liquor independent of any laundry detergent composition or may conveniently be added to the laundry bath during the wash cycle in conjunction with a liquid or granular detergent composition.

The method of preparation of the aqueous emulsion is predicated upon forming an emulsion or suspension which is stable over a practical range of temperatures, and particularly at high temperature, namely, it does not undergo phase separation at temperatures up to about 120° F., and, in addition, the particles of fabric conditioning composition which comprise the dispersed phase of the emulsion must be of the requisite size to deposit on washed fabrics during the wash cycle. It has been discovered that when present in an emulsion at particle sizes having a median diameter above about 10 microns, preferably from about 25 to 100 microns, and most preferably from about 25 to 50 microns, the composition of the invention is capable of providing effective softening and anti-stat properties to washed fabrics whereas at particles sizes below such value fabric conditioning is often adversely affected. Although the applicant does not wish to be bound by any theory, it is believed that particle sizes of above about 10 microns are required in order to effect deposition of said particles on fabrics in the wash water, such particle size limitation not being critical for rinse cycle softening.

To insure high temperature stability and the avoidance of phase separation, the HLB (hydrophilic-lipophilic balance) value of the emulsion is preferably regulated to within a predetermined range required for stability by the addition of suitable emulsifying agents. The required range of HLB is readily determined by trial and error for each particular combination of tertiary amine and carboxylic acid utilized in the composition of the invention. For the particular instance where citric acid and methyl di(hydrogenated tallow) methyl amine are used to form the fabric conditioning composition, the HLB of the emulsion must be from about 11.5 to 12.5 to achieve the desired high temperature stability.

The liquid emulsion compositions preferably contain from about 5 to about 30%, and most preferably from about 7 to about 20% of the fabric conditioning composition of the invention, based on the total weight of the emulsion composition. At such concentrations, an effective amount of fabric conditioning composition is provided to the wash fabric when dispensing an amount of the liquid emulsion to the wash or rinse cycle of an automatic 7ashing machine comparable to the amounts added by users of commercial liquid fabric conditioners.

Nonionic surfactants are among the preferred emulsifying agents for preparing an emulsion in accordance with the invention having the desired stability, viscosity and particle size of fabric conditioning composition in the dispersed phase. Among the useful emulsifying agents are Neodol 25-3 (an ethoxylated alcohol sold by Shell Chemical Company comprising a fatty alcohol averaging about 12 to 15 carbon atoms with about 3 moles of ethylene oxide per mole of alcohol); Neodol 25-12; and Neodol 45-13. Neodol 25-3 and 45-13 are particularly preferred for this purpose.

The preparation of the emulsion is conveniently effected in three stages: in the first stage the fabric conditioning composition, preferably at a temperature above its melting point, is added to an aqueous liquid, preferably water, along with a first portion of an emulsifying agent, such first portion being an amount selected to form upon mixing with the fabric conditioning composition particles of emulsified fabric conditioning composition having a median diameter above about 10 microns. The order of addition of the fabric conditioning composition and the first portion of emulsifying agent is not critical. It is preferred that the aqueous liquid be preheated to a temperature corresponding to at least the melting point of the fabric conditioning composition if the latter is introduced as a liquid. This is to insure that the emulsified particles formed in the first stage are in liquid form. In an alternate embodiment, the fabric conditioning composition is introduced into the aqueous liquid as a solid, following which the liquid is heated to a temperature sufficiently above the melting point of the conditioning composition such that upon mixing the conditioning composition with the first portion of emulsifying agent, there is provided an emulsion containing as the dispersed phase liquid particles of fabric conditioning composition having the desired particle size.

In the second stage the resulting emulsion is cooled to a temperature sufficiently below the melting point of the fabric conditioning composition so as to at least partially solidify the emulsified particles and &/rm a suspension of solid particles in the aqueous liquid. In the third stage, a second portion of one or more emulsifying agents is added to the emulsion or suspension formed in the second stage so as to adjust the HLB value to that required for high temperature stability. This HLB value can be conveniently determined by a simple trial and error technique. As defined herein, the characterization of "high temperature stability" for a liquid emulsion in accordance with the invention refers to its being able to be maintained at 120° F. for at least 24 hours without the occurrence of phase separation. After the formation of the emulsion in the third stage, electrolytes such as calcium chloride dihydrate, or sodium chloride may be added as viscosity modifiers, if needed, as well as defoaming materials to enhance proper mixing of the components by inhibiting phase separation resulting from foam agitation. Other optional components include colorants and perfume 7hich are advantageously added sequentially under agitation.

The emulsified particles in the dispersed phase of the emulsion are not all of uniform size and comprise a broad distribution of particle sizes, but it is required that the median diameter of such particles be above 10 microns. A preferred particle size is that having a mean diameter of from about 25 to 50 microns. Measurement of the emulsified particles is most conveniently carried out at the end of the third stage 7hen the final emulsion is formed rather than at the end of the first stage 7here the relatively strong association of the emulsified particles may make the particle size measurement somewhat less accurate.

The aforementioned three-stage method of preparation is predicated upon utilizing a fabric conditioning composition having a melting point above ambient temperature such that in the first stage of preparation only a limited amount of emulsifying agent is added to provide the desired size of emulsified particles as a dispersed liquid phase. Thereafter upon cooling, the dispersed particles solidify, allowing additional amounts of emulsifying agent to be added to the emulsion 7ithout causing any diminution in particle size. Thus, the HLB of the emulsion can be independently adjusted to the desired range without affecting the size of the particles in the dispersed phase.

EXAMPLE 1

A liquid emulsion in accordance with the invention was prepared as follows:

To 0.3 grams of Methocel A4C$^R$, a methylcellulose marketed by D/w Chemical C/mpany, there was added 5 grams of deionized water at 70° C. and mixed to form a paste. This paste was added to 79.46 grams of water at 25° C. and thoroughly mixed to obtain a uniform dispersion, which 7as then heated 43° C.

Amine citrate complex was prepared by adding 0.65 grams of anhydrous citric acid to 9.35 grams of melted methyl di(hydrogenated tallow) amine (sold commercially as Armeen M2HT by Akzo Chemicals Incorporated) corresponding to a molar ratio of tertiary amine to citric acid of 5.2 to 1 and the mixture heated till all the citric acid is melted and dissolved in the amine (approximate temperature: 115° C.). The solution 7as then cooled to room temperature where it solidified.

The amine citrate complex plus the unreacted amine was thereafter melted by heating to about 70° C. and added to the methylcellulose dispersion described above at 43° C. under gentle agitation to form a smooth, white emulsion having a cream-like consistency. This emulsion was cooled to approximately 40° C. and 0.2 grams of Neodol 45-13 (a tradename for a Shell Chemical C/mpany detergent which is a condensation product of a mixture of fatty alcohols averaging about 14 to 15 carbon atoms 7ith about 13 moles of ethylene oxide per mole of alcohol) dissolved in 0.8 grams water was added to it while mixing. The emulsion was gradually cooled to 25° C. to let the particles solidify.

The particle size of the dispersed phase as determined by a HIAC/ROKO Particle Size Analyzer (Model PA 720) marketed by Pacific Scientific C/mpany was about 35 microns mean diameter. Such Analyzer uses established light blocking principles for measuring the particle size mean diameter whereby the measured particles interrupt a continuous light beam when passing through a sensing zone 7hich, in turn, causes a reduction in the amount of light reaching a photo detector. This technique is particularly advantageous for measuring particle sizes larger than the normal range of particles conventionally measured by light scattering techniques.

To this solution there was added, 7hile mixing, 0.6 grams of Neodol 45-13 dissolved in 2.4 grams water followed by 0.35 grams of Neodol 25-3. The HLB of the emulsion following the addition of these emulsifying agents was about 12.

A commercial defoaming material (0.02 grams) was then added to the resulting emulsion followed by the addition of adjuvants such as perfume (0.5 grams) dye (0.015 grams) and preservative (0.1 gram of Ucarcide marketed by Union Carbide Corporation), all while mixing. A minor amount of silicone (0.25 grams of Dow C/rning 193) was then added to modify the viscosity.

The resulting emulsion was highly stable over a temperature range from ambient to at least 110° F., and, in particular, did not manifest any particle break down and phase separation when aged at high temperature, namely a minimum of 24 hours at a temperature of 110° F. or above.

EXAMPLE 2

A liquid emulsion of the invention was prepared utilizing as the alkyl cellulose ether a derivative of hydroxyethyl cellulose (HEC) in which the hydroxyl hydrogen of the ethyl hydroxyl group on the 5th carbon of the ring is replaced by a fatty alkyl chain having from 10 to 24 carbon atoms. Such HEC derivative polymers are sold under the trademark "Natrosol Plus" by Hercules Chemical Company.

An amine-citrate complex was prepared by adding 0.654 gms of anhydrous citric acid crystals to 9.34 gms of molten methyl-di (hydrogenated tallow) tertiary amine (sold commercially as Armeen M2HT by Akzo Chemicals, Inc.) and the mixture was maintained at a temperature of about 115° C. until the citric acid complexed 7ith the amine. The resulting binary mixture with excess-free amine was cooled to room temperature under ambient conditions to obtain a white solid cake.

Deionized water (89.33 gms) was heated to about 48° C. using a bench top hot plate. Amine-citrate complex (9.994 gms) prepared according to the aforementioned procedure was melted in a microwave oven and added slowly to the above hot water under gentle agitation using a paddle mixer. The mixing was continued for about 10–15 minutes and the resulting milky emulsion was cooled to 40° C. and maintained at this temperature.

To this amine-citrate emulsion there 7as then slowly added 0.06 grams of the above described HEC derivative polymer while maintaining gentle agitation. The emulsion was mixed for an additional 10 minutes and then allowed to cool to ambient temperature (approximately 25° C.). To the above cooled emulsion 0.2 grams of liquid Neodol 25-13 (marketed by Shell Chemical Company) 7as added followed by the addition of color and perfume to complete the prototype preparation. The above method of preparation resulted in a smooth and milky emulsion having cream like consistency.

The particle size of the emulsion was measured using Olympus BM-2 microscope and the average particle size was found to be in the range of 15–25 microns. The emulsion did not separate or manifest any particle disintegration 7hen heated to a temperature of about 110° F. This was confirmed by a hot-stage video-microscopy. The emulsion was stable over a range of temperature from ambient to 110° F. The emulsion was also stable under heat-cool (110° F. to ambient) cycling conditions.

EXAMPLE 3

To demonstrate the improved stability of a fabric conditioning liquid emulsion in accordance with the invention, a comparison was made with the emulsion described in U.S. Pat. No. 4,869,836 to Harmalker, in Example 5, the disclosure of which is incorporated herein by reference. The fabric conditioning compositions described in the Harmalker patent are similar to that described herein except for the absence of an alkyl cellulose ether.

The particle size of an emulsion prepared as set forth in Example 1 above was measured at room temperature with the HIAC/ROKO particle size analyzer. The particle size was about 35 microns mean diameter. / change in particle size was noted after about 24 hours. A second sample of the same emulsion was maintained at a temperature of about 110° F. for 24 hours and its particle size then measured. The resulting particle size was unchanged, about 35 microns mean diameter.

By 7ay of comparison, a liquid emulsion was prepared in accordance with Example 5 of U.S. Pat. No. 4,869,836 and its measured particle size at room temperature was about 35 microns mean diameter. No change in particle size was noted after about 24 hours. A second sample of this same emulsion was maintained at a temperature of about 110° F. for 24 hours and the resulting measured particle size was below 10 microns mean diameter, indicating instability of the emulsion at elevated temperatures.

EXAMPLE 4

A commercial granular detergent composition designated herein as Control "A" 7as used in this example and had the following composition:

| Component | Control A Weight Percent |
|---|---|
| Linear alkylbenzene sulfonate | 4 |
| Sodium fatty alcohol sulfate | 9 |
| Sodium ethoxy alcohol sulfate | 3 |
| Polyethoxylated alcohol | 0.7 |
| Pentasodium tripolyphosphate | 31 |
| Sodium pyrophosphate | 7 |
| Sodium carbonate | 9 |
| Sodium sulfate | 16 |
| Sodium silicate | 5 |
| Moisture and adjuvants | Balance |

The following washing procedure was used to evaluate the efficacy of a composition in accordance with the invention (the composition of Example 1) and a comparative composition as described in the aforementioned U.S. Pat. No. 4,869,836, Example 5 thereof. Each of the aforementioned liquid compositions in an amount of 90 grams was added along with 86 grams of Control A to a U.S. top-loading washing machine. A 6½ lb ballast wash load comprised of cotton and synthetic &abrics was washed 7ith 64 liters of 7ater at 90° F. using a fourteen minute wash cycle with rinse and spin operations followed by drying for one hour in an electric dryer. The washing and drying steps were then repeated and following the second drying operation the fabrics were evaluated for their anti-static properties by visual inspection. The terry towels in each wash load were then equilibrated to 40% humidity overnight and the following day 7ere evaluated for softness by a six member panel. The results of the static and softness evaluation for each of the tested compositions is described in Table 1.

EXAMPLE 5

The physical characteristics of the liquid emulsion of the invention described in Example 1 was compared with a liquid emulsion not in accordance with the invention containing a cellulose ether derivative such as described in U.S. Pat. No. 4,808,086 to Evans et al.

A composition "D" was prepared following the exact procedure of Example 1 except that in place of the Methocel A4C$^R$ of Example 1 present at 0.3% there was substituted Methocel A15LV, a methyl cellulose sold by D/w Chemical, 7hich is disclosed in U.S. Pat. No. 4,808,086 at Table 1, C/lumn 9 as a soil release agent. The weight present of this methyl cellulose in the composition was 10%, a concentration substantially below the most preferred weight range of 25-50% of the fabric conditioning compositions recommended by the Evans et al patent at col. 1, line 54.

The resulting composition "D" 7as a non-flowable, non-pourable thick paste.

A second composition "E" was prepared following the exact procedure of Example 1 except that in place of Methocel A4C$^R$ at 0.3%, there 7as substituted Polymer JR-125 which is described in U.S. Pat. /. 4,808,086 at column 2, line 61 as a soil release agent. This polymer was used in the composition at a weight percent of 10%, below the most preferred weight range of 25-50% recommended for its use by the Evans et al patent.

The resulting composition "E" 7as a non-flowable, non-pourable thick paste.

By way of comparison, the liquid emulsion of Example 1 was readily pourable having a viscosity of about 600 centipoise at room temperature.

TABLE 1

PERFORMANCE OF FABRIC CONDITIONING COMPOSITIONS OF THE INVENTION

| Formulation | Softness(a) | Static(b) |
|---|---|---|
| Control A | — | Very heavy |
| Control A + comparative composition Of U.S. Pat. No. 4,869,836 | +3 | Light to none |
| Control A + composition of invention (Example 1) | +4 | None |

conditions: wash cycle, 90° F. for 14 minutes;
base composition: 84 g of Control A
(a)Softness: difference in softness measured is based on a scale of 1 (very harsh) to 10 (very soft) relative to Control A as evaluated by a six-member panel. A difference of one unit or greater is considered significant. Control A provided a softness of from 3 to 4 when evaluated, on an absolute basis, on a scale of 1 to 10.
(b)The anti-static properties were characterized visually.

What is claimed is:

1. A wash cycle or rinse cycle-additive aqueous liquid emulsion for providing softness and anti-static properties to fabrics treated therewith in a laundry bath without adversely affected fabric cleaning comprising:

(A) from about 1 to 30%, by weight of a particulate fabric conditioning composition having a median particle diameter greater than about 10 and up to about 50 microns comprising:

(a) a fabric conditioning amount of a multi-functional carboxylic acid complex of a tertiary amine formed from the reaction of (i) and tertiary amine having the general formula:

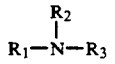

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having from 21 to 54 carbon atoms;

(b) unreacted tertiary amine having the general formula defined above, said unreacted amine being present in an amount of at least 0.2 times the stoichiometric amount of tertiary amine required to form the multi-functional carboxylic acid complex of (a); and (c) a stabilizing amount from about 0.1 to 1% by weight of the aqueous liquid emulsion, of an alkyl cellulose ether to substantially prevent particle break-down of said particulate fabric conditioning composition, said alkyl cellulose ether being selected from the group consisting of methylcellulose, hydroxypropylmethyl cellulose and derivatives of hydroxyethyl cellulose wherein the terminal hydrogen of the hydroxyether group is replaced by an alkyl chain having from 10 to 24 carbon atoms, and mixtures thereof, said alkyl cellulose ether having a molecular weight of at least 25,000, the stabilizing amount of alkyl cellulose ether relative to the fabric conditioning amount of carboxylic acid complex of a tertiary amine defined in (a) being less than about 1:20, by weight, and 7hich stabilizing amount of cellulose ether provides no improved fabric softening performance for said fabric conditioning composition, the dispersed phase of the liquid emulsion being essentially comprised of said particles of fabric conditioning composition;

(B) from about 0.1 to 10%, by weight of one or more emulsifying agents; and (C) the balance water.

2. A 7ash cycle or rinse cycle-additive liquid emulsion according to claim 1 wherein the tertiary amine is methyl distearyl amine.

3. A wash cycle or rinse cycle-additive liquid emulsion according to claim 1 wherein the tertiary amine is methyl di(hydrogenated tallow) amine.

4. A wash cycle or rinse cycle-additive liquid emulsion according to claim 1 wherein $R_2$ and $R_3$ are each an alkyl group.

5. A wash cycle or rinse cycle-additive liquid emulsion according to claim 1 7herein the multifunctional carboxylic acid is citric acid.

6. A wash cycle or rinse cycle-additive liquid emulsion according to claim 1 wherein said unreacted amine is present in an amount of from about 0.3 to 6 times the stoichiometric amount of tertiary amine reacted to form said complex.

7. A wash cycle or rinse cycle-additive liquid emulsion according to claim 1 wherein the fabric conditioning composition is present in an amount of from about 5 to about 20%, by weight.

8. A wash cycle or rinse cycle-additive liquid emulsion according to claim 1 which further contains a compound for providing anti-static properties additional to that provided by said fabric conditioning composition.

9. A wash cycle or rinse cycle-additive liquid emulsion according to claim 1 wherein the alkyl cellulose ether is present in an amount from about 0.1 to 0.5%, by weight.

10. A 7ash cycle or rinse cycle-additive liquid emulsion according to claim 1 7herein the viscosity of the aqueous liquid emulsion is substantially unaffected by the presence of the alkyl cellulose ether.

11. A process for imparting softness and anti-static properties to fabrics comprising the step of contacting the fabrics in a laundry wash or rinse liquor with an aqueous liquid emulsion containing an effective amount of a particulate fabric conditioning composition having a median particle diameter greater than about 10 and up to about 50 microns comprising:

(a) a fabric conditioning amount of a multi-functional carboxylic acid complex of a tertiary amine formed from the reaction of (i) a tertiary amine having the general formula:

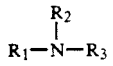

7herein $R_1$ is methyl or ethyl, and $R_2$ and $R_3$ are each independently an aliphatic group having from 12 to 22 carbon atoms, and (ii) a multifunctional carboxylic acid selected from the group consisting of citric acid, and di and tricarboxylic acids having 21 to 54 carbon atoms;

(b) unreacted tertiary amine having the general formula defined above, said unreacted amine being present in an amount of at least 0.2 times the stoichiometric amount of tertiary amine required to form the multifunctional carboxylic acid complex of (a); and (c) an emulsion stabilizing amount from about 0.1 to 1% by weight of the aqueous liquid emulsion of an alkyl cellulose ether selected from the group consisting of methylcellulose, hydroxypropylmethyl cellulose and derivatives of hydroxyethyl cellulose wherein the terminal hydrogen of the hydroxyether group is replaced by an alkyl chain having from 10 to 24 carbon atoms, and mixtures thereof, said alkyl cellulose ether having a molecular weight of at least 25,000, the emulsion stabilizing amount of alkyl cellulose ether relative to the fabric conditioning amount of carboxylic acid complex of a tertiary amine defined in (a) being less than about 1:20, by weight, and which emulsion stabilizing amount of cellulose ether provides no improved fabric softening performance for said fabric conditioning composition.

12. A process in accordance with claim 11 7herein the multifunctional carboxylic acid is citric acid.

13. A process in accordance 7ith claim 11 wherein the tertiary amine is methyl di (hydrogenated tallow) amine.

14. A process in accordance with claim 11 7herein the unreacted amine is present in an amount of from about 0.3 to 6 times the said stoichiometric amount.

15. A process for preparing a stable wash cycle or rinse cycle-additive aqueous liquid emulsion according to claim 1 comprising the steps of:

(a) providing an aqueous liquid containing a mixture of (i) a fabric conditioning amount of the multifunctional carboxylic acid complex of a tertiary amine as defined in claim 1; (ii) unreacted tertiary amine as defined in claim 1; and (iii) an alkyl cellulose ether as defined in claim 1;

(b) heating the aqueous liquid prior to or subsequent to step (a) to a temperature sufficient to at least melt the mixture of carboxylic acid complex and unreacted tertiary amine;

(c) introducing into said aqueous liquid a first portion of an emulsifying agent, other than an alkyl cellulose ether said first portion being an amount selected to form upon mixing with said aqueous liquid emulsified particles containing components (i), (ii), and (iii) and having a median particle diameter greater than about 10 microns;

(d) mixing the aqueous liquid with the first portion of emulsifying agent to form an emulsion containing the aforesaid emulsified particles as the dispersed phase;

(e) cooling the resulting emulsion to a temperature sufficiently below the melting point of the particles formed in step (d) to at least partially solidify said particles; and (f) introducing into the emulsion following step (e) a second portion of one or more emulsifying agents to adjust the HLB value of the emulsion to that required for high-temperature phase stability.

16. A process in accordance with claim 15 wherein in step (a) the mixture of carboxylic acid complex and unreacted amine is introduced into the aqueous liquid at a temperature below its melting point and wherein subsequent to step (a) said aqueous liquid is heated to a temperature sufficiently above the melting point of the mixture.

17. A process in accordance with claim 15 7herein the tertiary amine in said fabric conditioning composition is methyl di(hydrogenated) tallow amine.

18. A process in accordance 7ith claim 15 wherein the multifunctional carboxylic acid in said fabric conditioning composition is citric acid.

19. A process in accordance with claim 15 wherein the amount of unreacted tertiary amine in the aqueous liquid is from about 0.3 to 3 times the stoichiometric amount of amine reacted to form the carboxylic acid complex.

20. A process in accordance with claim 15 wherein the amount of unreacted tertiary amine in the liquid is from about 5 to 30%, by weight, of said liquid.

21. A process in accordance 7ith claim 15 further including the step of introducing a viscosity modifier and optionally other adjuvants into said aqueous liquid.

22. A process in accordance with claim 15 wherein in step (d) the emulsified particles of fabric conditioning composition have a median diameter of from about 25 to 50 microns.

* * * * *